US008127858B2

(12) United States Patent
Lynde et al.

(10) Patent No.: US 8,127,858 B2
(45) Date of Patent: Mar. 6, 2012

(54) OPEN-HOLE ANCHOR FOR WHIPSTOCK SYSTEM

(75) Inventors: Gerald D Lynde, Houston, TX (US); Yang Xu, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 562 days.

(21) Appl. No.: 12/338,604

(22) Filed: Dec. 18, 2008

(65) Prior Publication Data

US 2010/0155083 A1 Jun. 24, 2010

(51) Int. Cl.
*E21B 23/01* (2006.01)

(52) U.S. Cl. ..... 166/383; 166/120; 166/212

(58) Field of Classification Search ..... 166/382, 166/212, 383, 134, 120
See application file for complete search history.

(56) References Cited

U.S. PATENT DOCUMENTS

| | | | | |
|---|---|---|---|---|
| 2,509,144 | A | 5/1950 | Grable et al. | |
| 2,743,781 | A * | 5/1956 | Lane | 166/212 |
| 2,855,049 | A * | 10/1958 | Zandmer | 166/100 |
| 2,874,783 | A * | 2/1959 | Haines | 166/212 |
| 3,363,695 | A * | 1/1968 | McGill | 166/120 |
| 3,385,364 | A * | 5/1968 | Whitten | 166/100 |
| 3,448,805 | A * | 6/1969 | Brown | 166/212 |
| 5,379,838 | A * | 1/1995 | Wilson et al. | 166/242.1 |
| 5,425,424 | A * | 6/1995 | Reinhardt et al. | 166/291 |
| 5,499,682 | A | 3/1996 | Sieber | |
| 5,720,349 | A | 2/1998 | Pleasants et al. | |
| 5,829,520 | A * | 11/1998 | Johnson | 166/250.01 |
| 5,871,046 | A | 2/1999 | Robison | |
| 6,076,606 | A | 6/2000 | Bailey et al. | |
| 6,209,636 | B1 | 4/2001 | Roberts et al. | |
| 6,334,487 | B1 | 1/2002 | Adkins et al. | |
| 6,554,062 | B1 | 4/2003 | Dewey et al. | |
| 6,695,056 | B2 | 2/2004 | Haugen et al. | |
| 6,935,431 | B2 | 8/2005 | Dewey et al. | |
| 7,422,069 | B2 * | 9/2008 | Richard et al. | 166/382 |
| 7,431,107 | B2 * | 10/2008 | Hill et al. | 175/246 |
| 7,798,213 | B2 * | 9/2010 | Harvey et al. | 166/242.7 |
| 7,806,192 | B2 * | 10/2010 | Foster et al. | 166/387 |
| 2004/0069496 | A1 | 4/2004 | Hosie et al. | |
| 2008/0105436 | A1 * | 5/2008 | Molina et al. | 166/365 |

FOREIGN PATENT DOCUMENTS

| | | |
|---|---|---|
| CA | 2296464 | 2/1999 |
| CA | 2480259 | 10/2003 |
| EP | 0227456 A3 | 7/1987 |
| EP | 0701043 A3 | 8/1998 |

(Continued)

OTHER PUBLICATIONS

Jeffrey L. Foster, Kelly T. Olds, R Paul K Stebbings, Leo A. Giangiacomo, Doug Durst, and Thurman Carter, "Improving Multilateral Drilling and completion Efficiency with a hollow Whipstock", Presentation at the 1998 IADC/SPE Drilling Conference, Society of petroleum Engineers and International Association of Drilling Contractors, IADC/SPE 39367,Dallas, Texas, Mar. 3-6, 1998, pp. 629-640.

(Continued)

*Primary Examiner* — Daniel P Stephenson
(74) *Attorney, Agent, or Firm* — Cantor Colburn LLP

(57) ABSTRACT

An anchoring system including a housing; a chamber defined by the housing; and one or more telescopic assemblies disposed in contact with a wall of the housing and responsive to pressure within the chamber and a method for anchoring a tool in a wellbore.

23 Claims, 3 Drawing Sheets

FOREIGN PATENT DOCUMENTS

| | | | |
|---|---|---|---|
| GB | 2412397 | B | 9/2006 |
| WO | 9100410 | A1 | 1/1991 |
| WO | 9523273 | A3 | 8/1995 |

OTHER PUBLICATIONS

David W. Cundiff, "Open/Cased Hole Inflatable Whipstock Anchor", Presentation at the SPE Production and Operations Symposium, Society of Petroleum Engineers, Oklahoma City, OK, Mar. 24-27, 2001, SPE 67261, pp. 1-12.

Robert Hinojosa, Jimmy Ryan and Richard Wyman, Whipstock Performance Review in Gulf Coast Region Yields Operational, Presentation at the 1998 IADC/SPE Drilling Conference, Society of petroleum Engineers and International Association of Drilling Contractors, IACE/SPE 39402, Dallas, Texas, Mar. 3-6, 1998, pp. 907-912.

Lynn B. Dooley, Gary L. Faul, David Courville, Danny Harrell, Jonathan A. Shipley, "Planning and Execution of a Long, Tight Clearance Liner Through a Whipstock Milled Window", Presentation at the IADC/SPE Drilling Conference, Society of petroleum Engineers and International Association of Drilling Contractors, IADC/SPE 87167, Dallas, Texas, Mar. 2-4, 2004, pp. 1-11.

* cited by examiner

OPEN-HOLE ANCHOR FOR WHIPSTOCK SYSTEM

BACKGROUND

In the hydrocarbon industry, many tools are needed and are required to be anchored in a wellbore that may be oriented from vertically to horizontally and anywhere in between. To meet the need to hold the variety of tools needed to enhance wellbore production, many kinds of anchors have been developed over the years. One common type of anchoring arrangement uses slips and a source of energy to urge the slips into a casing wall or open hole to anchor a component that may be attached to the anchor or may be connectable therewith at a later time. While known anchors function well for their intended purposes, the hydrocarbon production industry is ever changing and new challenges are constantly being encountered regarding all parts of the recovery of the target fluids. For this reason, the art is always receptive to new devices and methods that provide additional options for the arsenal in the quest for energy.

SUMMARY

An anchoring system including a housing; a chamber defined by the housing; and one or more telescopic assemblies disposed in contact with a wall of the housing and responsive to pressure within the chamber.

A method for anchoring a tool in a wellbore including running an anchoring system including a housing; a chamber defined by the housing; and one or more telescopic assemblies disposed in contact with a wall of the housing and responsive to pressure within the chamber into the wellbore; pressuring on the one or more telescopic assemblies; extending the one or more assemblies radially of the housing; and contacting the one or more assemblies with a structure in which the system is to be set.

BRIEF DESCRIPTION OF DRAWINGS

Referring now to the drawings wherein like elements are numbered alike in the several Figures.

DETAILED DESCRIPTION

Figure 1:
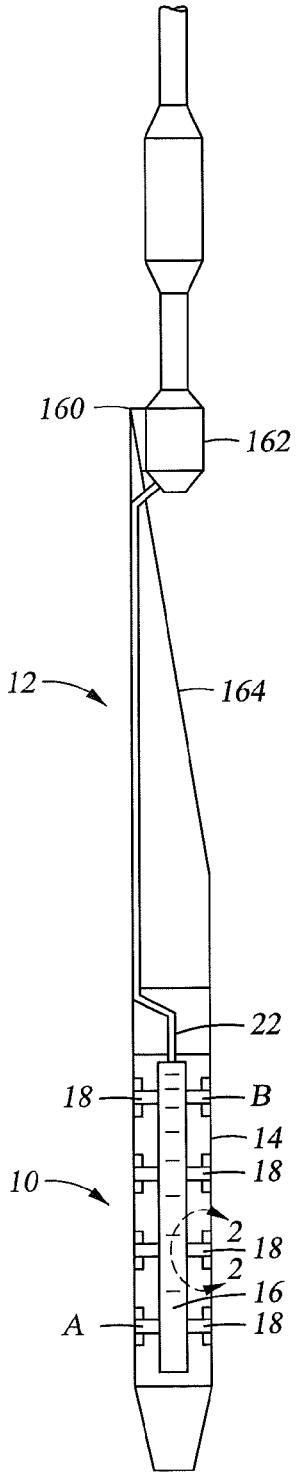
FIG. 1 is a schematic representation of an anchoring system connected to a downhole tool.

Referring to FIG. 1, a telescopic anchoring system 10 is illustrated connected to a downhole tool 12, which in this case is illustrated to be a whipstock. It is to be appreciated that other tools could be substituted without departing from the scope of the invention. The anchoring system 10 includes a housing 14 defining a fluid chamber 16. Fluid in the chamber 16 is to have energy transferring access to one or more telescopic assemblies 18. In one embodiment and as illustrated, the access is direct fluid access to the one or more assemblies

18. While eight are shown, it is noted that more or fewer may be used at will with consequent lengthening or shortening of the housing 14 being permissible if desired. The access may be effected by having the one or more assemblies actually define a portion of the chamber 16 as in FIG. 1, may be through a channel 20 as in FIG. 2, or some other arrangement that provides energy transfer from the pressure in the fluid to the one or more telescopic assemblies 18. Energy transfer, it is to be understood can be from direct fluid contact with the one or more assemblies 18 or through a piston like interface between the one or more assemblies and the fluid itself.

Still referring to FIG. 1, one embodiment for providing the fluid pressure to the chamber 16 is illustrated to be a hydraulic line 22 from a remote pressure source. The remote source may be at the surface or some other location. Regardless of where the pressure comes from, it is provided to the chamber 16 and will hence act on the one or more telescopic assemblies 18. Upon a pressure increase in the chamber 16, and assuming no restraint (discussed hereunder), the telescopic assemblies 18 will begin to extend radially outwardly of the housing 14 and ultimately into contact with a tubular structure more radially outwardly disposed than the housing 14, that tubular structure being an open hole or a casing or other placed tubing. It is to be appreciated that although the discussion herein is directed to a radially outward extension of the one or more assemblies 18, they could be configured to telescope radially inwardly by reversing their orientation and providing the pressure source at a more radially outward position thereby acting on the one or more telescopic assemblies 18 in a radially inward direction.

In conditions where the system 10 is naturally centralized such as is sometimes possible in a vertical wellbore section, the one or more assemblies 18 are relatively likely to extend at roughly the same rate and contact the structure at roughly the same time. Where however, the system 10 is not centralized, either naturally or by other selective means, it is likely that one or more of the one or more assemblies will extend before others of the one or more assemblies simply because of resistance to such extension by the structure where that structure is closer to the housing 14 than at other locations on the housing. In such cases, the assemblies 18 that are not encumbered by early contact with the structure will extend first until they either make contact with the structure or until they have reached their individual maximum extension position.

After this, the otherwise inhibited assemblies will extend under increasing pressure from the chamber 16 and resultingly anchor the system 10.

Figure 2:
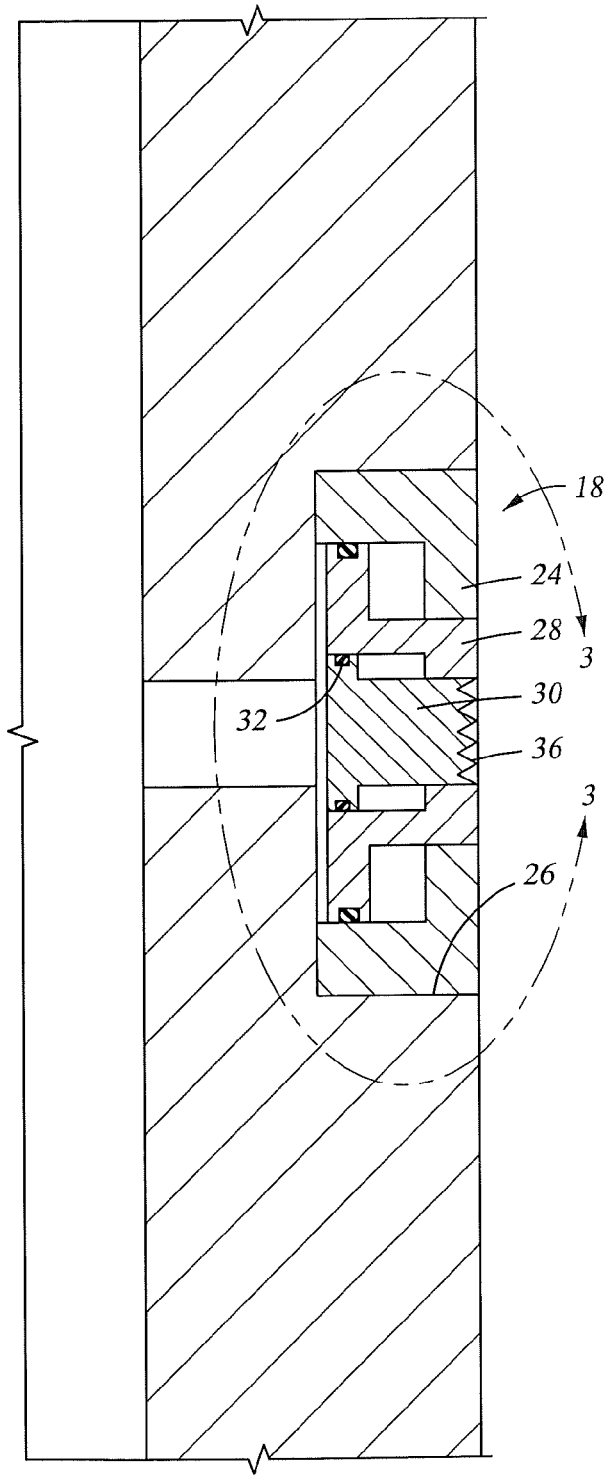
FIG. 2 is an enlarged view of circumscribed area 2-2 in FIG. 1.
Figure 3:
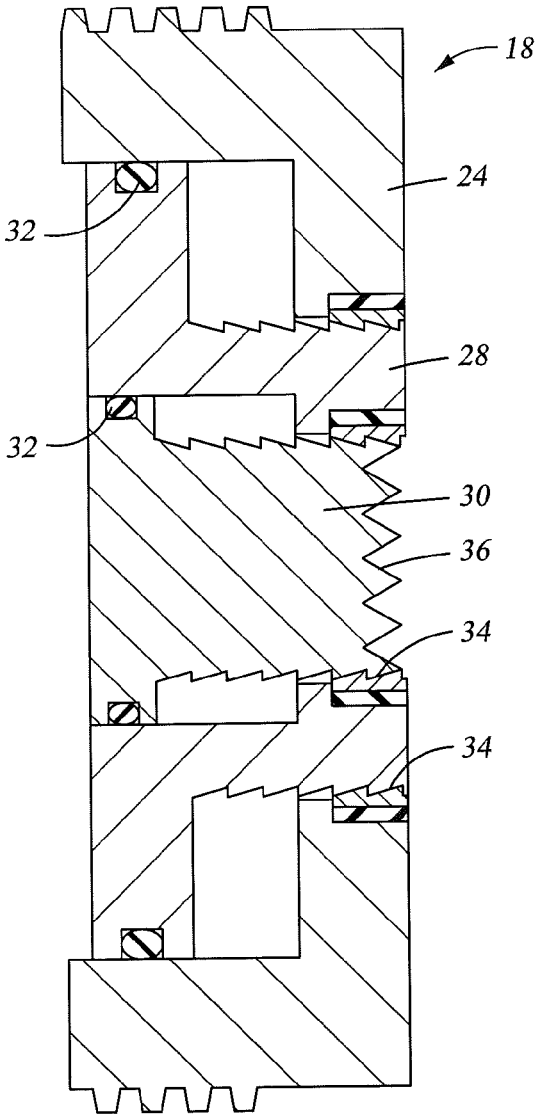
FIG. 3 is a further enlarged view of circumscribed area 3-3 in FIG. 2.

In order to make the extension mechanism understood, reference is made to FIGS. 2 and 3 where one of the telescopic assemblies 18 is illustrated progressively enlarged. As illustrated, the telescopic assembly 18 comprises a double telescopic configuration. It is to be appreciated however that any number of telescopic sections may be employed from one to any number limited only by practicality. It will be appreciated that the illustrated configuration is provided by way of example only. The assembly 18 includes a cap 24 that may be configured to engage a receptive opening 26 in housing 14 by adhesive, threaded, fused, welded, etc. means. It is intended that in one embodiment, the cap 24 be fluid sealed to the housing 14, which may be accomplished by fully adhering or welding the cap 24 to the housing 14 or by using a seal such as an o-ring at a threaded interface. A metal-to-metal seal is also possible with appropriately configured thread flanks the construction of which is known to the art.

Slidingly disposed within the cap 24 is an intermediate extender 28 that provides for additional total radial extension of the assembly than would be possible if the intermediate extender 26 were not employed. As noted earlier however, it is to be appreciated that the number of intermediate extenders 28 is not limited to one but additional extension can be achieved and is contemplated herein through the use of additional intermediate extenders with successively smaller diameters relative to the cap 24.

Figure 5:
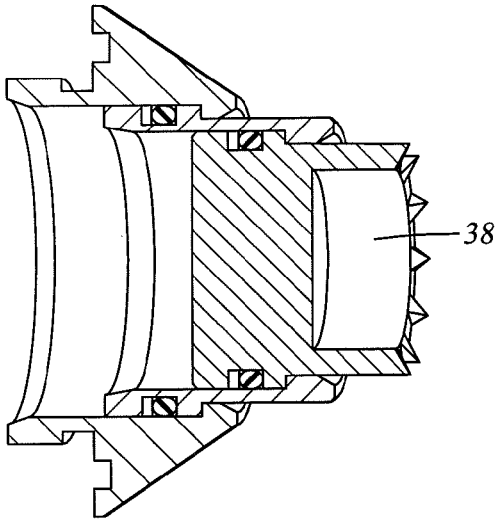
FIG. 5 is a perspective view of a telescopic assembly as described herein.
Figure 6:
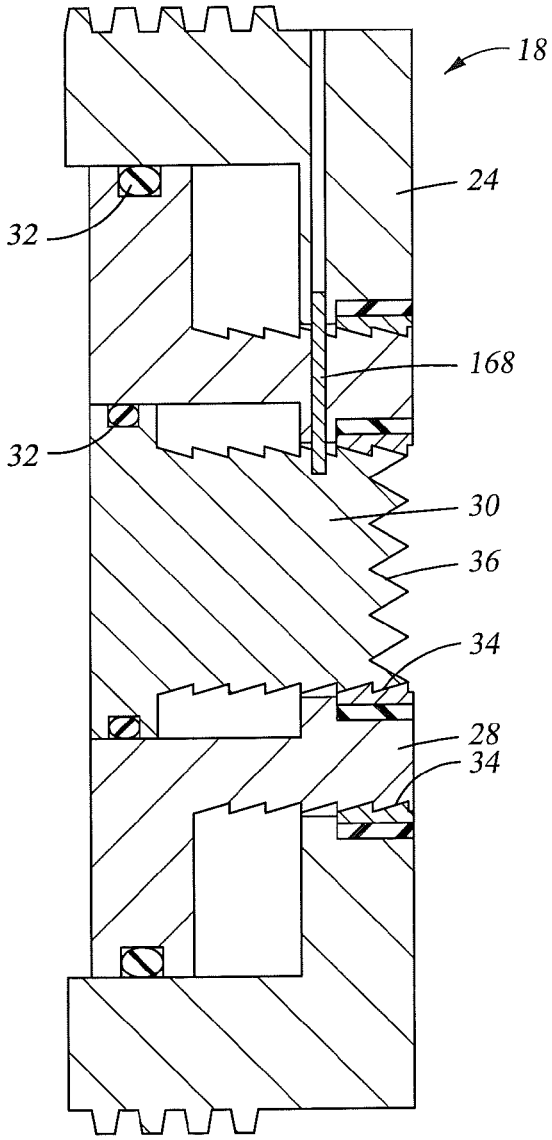
FIG. 6 is a view similar to that of FIG. 3 but including a representation of a release mechanism.

Again slidingly disposed is the anchor extender 30, which slides on the intermediate extender 28, in this embodiment. Each of the sliding surfaces will include a fluid seal of some kind such as an o-ring 32 (most easily visible in FIG. 3). In the condition so described the assemblies 18 are functional but further there are additional features that can be used together or individually in any combination. These include ratchet surfaces 34 that can be included between the intermediate extenders 28 and the cap 24, between the intermediate extenders 28 and the anchor extender 30 or both as desired. These surfaces allow one-way movement of the extender components relative to the cap 24 or each other so that upon deployment of the assemblies 18 the ratchet surfaces will allow movement in one direction but not in the other direction. Such a configuration is useful if the anchoring arrangement is intended to be permanent and the fluid pressure supply is intended to be temporary. Another feature of the assemblies 18 is a castellated contact end 36 for increasing engagement friction with a structure to which the system is to become anchored. Moreover, because it is contemplated that the system 10 will be used additionally in open hole wellbores, the anchor extender 30, in one embodiment includes a concavity 38 illustrated in FIG. 5. Where the structure with which the anchor extender 30 is intended to engage is relatively soft material, the extender 30 will tend to core its way into the material, such as the formation, thereby providing enhanced anchoring and resistance to rotation of the system 10. This is helpful in many situations but particularly where a whipstock is mounted to the anchor system 10 due to rotational stress put on the whipstock by a mill being deflected there from.

Figure 4:
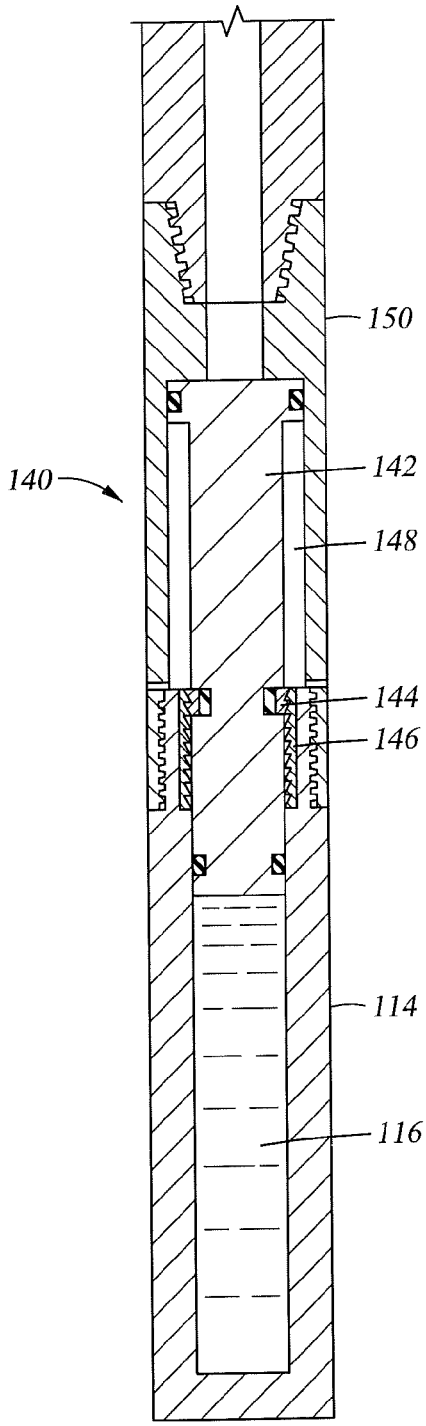
FIG. 4 is a schematic view of an alternate embodiment having a piston between a fluid pressure chamber and a selective pressure source.

In another embodiment, and referring to FIG. 4, an anchoring system 110 is illustrated having a housing 114 defining a fluid chamber 116 similar to the embodiment of FIG. 1 and having one or more telescopic assemblies just as are shown in FIG. 1 but not shown in FIG. 4. Distinct however from the FIG. 1 embodiment is a piston arrangement 140. This arrangement includes a piston 142 that is sealedly slidable relative to the housing 114 for the purpose of affecting fluid pressure of fluid within the chamber 116 of the housing 114. Through the affecting of the fluid pressure in chamber 116 the telescopic assemblies are deployed identically to that described above.

The embodiment of FIG. 4 provides several optional operational features that are not provided in the embodiment of FIG. 1. In one of these, the piston 142 is endowed with a ratcheting profile 144 that may be one way permanently configured or may be configured for both way movement based upon a selective overpull rating to move the profile in a direction opposite to that of setting of the anchor system. The ratcheting profile would be engagable with a body lock ring 146 or other complementary profile configured for the desired purpose. The existence of the ratcheting feature allows for pressure supplied from a remote source to be eliminated without the telescopic assemblies becoming unsupported. In the event that the ratcheting feature is subject to withdrawal by overpull, the anchor system can still be unset if desired. Since the piston 142 is sealedly slidable within the housing 114, this embodiment further allows for a reduced pressure to be generated within chamber 116 to tend to draw the telescopic assemblies away from the set position providing that the embodiment has assemblies 18 configured without ratchet surfaces 34, which would otherwise inhibit such movement.

Also depicted in FIG. 4 is another possible feature of the arrangement. This is a lower pressure chamber 148. This chamber 148 may be encompassed within housing 114 or may be configured as shown in a separate sub 150 as illustrated. The chamber 148 may be set at a pressure anywhere from under the hydrostatic pressure where the system is to be set to whatever vacuum can be achieved therein by a vacuum device to be effective. In one particular example, the chamber 148 may be an atmospheric pressure chamber. In each of these possible cases, because the pressure in the lower pressure chamber 148 is less than hydrostatic pressure in the wellbore at the location of deployment of the system 110, there will be a force acting on the piston 142 in the direction of setting of the telescopic assemblies to maintain a bias therein to further extend the assemblies if for some reason over time the tightness of the initial set is reduced. This can happen, for example, if the anchor extenders 30 continue to core into the formation due to vibration. In such event, the piston bias due to the lower pressure chamber 148 will cause the assemblies 18 to extend further and reestablish contact pressure against the formation. Further it is to be understood that while in some applications an applied pressure will be used similar to that of the FIG. 1 embodiment (this time it is applied to the top of the piston), the FIG. 4 embodiment may not require additional pressure applied from a remote location. In the event that the pressure differential between the lower pressure chamber 148 and the hydrostatic pressure is sufficient, no additional applied pressure would be necessary. It will be appreciated that a combination of additional applied pressure and resultant force from the lower pressure chamber 148 can be used in some embodiments.

Each of the iterations of the anchoring system described herein can have additional utility in creating biases relative to orientation of the system itself and therefore by association in whatever tool is attached thereto. In the case of a whipstock, such biasing capability may be employed to ensure that the uphole point of the whipstock 160 (see FIG. 1) is placed in contact with an inside surface of whatever structure the system and whipstock are set in. It will be appreciated by one of ordinary skill in the art that ensuring that the tip 160 be so located avoids problems associated with the mill 162 (see FIG. 1) landing on the tip 160 as opposed to the face 164 of the whipstock as is generally intended in whipstock use.

In order to make use of the selective biasing feature of the anchoring system disclosed herein, one or more of the one or more telescopic assemblies 18 are to be selectively and releasably restrained. In one embodiment, restraint 168 is affected by a shear pin in one or more of the one or more telescopic assemblies 18. Restraining selective ones of the assemblies facilitates earlier deployment of the unrestrained assemblies whereby the attitude of the system can be adjusted to a desired outcome. Using the whipstock embodiment illustrated in FIG. 1 as an example, it would be helpful to deploy the assembly 18 marked "A" first followed by deployment of the assembly marked "B" in order to cause tip 160 to be positioned most beneficially against a wall of the structure in which the system is set opposite from the wall of the structure that will be milled by the mill 162 deflecting off face 164. In this example, assembly A deployed before assembly B, which then would be deployed before one or more of the other assemblies that might be present. This requires that different release values are necessary for the restraint 168 in order to cause them to release at different times. In this embodiment, it is likely that assembly A would not be restrained at all so that there would be no impediment to its deployment. Assembly B would then be restrained to an intermediary value and the other assemblies 18 such as might be used in this embodiment for anchoring reliability reasons will be restrained until a higher deployment force is attained.

Although retrieval has been mentioned with respect to the FIG. 4 embodiment only thus far, it is noted that retrieval can be achieved in the other embodiments as well providing that they are not permanently set due to ratchet surfaces that do not release. In each case, a reduction in the pressure differential between the chamber 16 and the annulus pressure will result setting force being substantially removed from the telescopic assemblies. One configuration for equalizing this pressure differential is a burst disk that may be burst using over pressure or a mechanical or electrical impetus to rupture the disk. In the event that the assemblies did not core into the structure in which they were originally set, retrieval should at this point be a simple affair. If on the other hand coring did occur at initial set or over time, cycling movement of the anchor system to urge the assemblies out of the cores is anticipated to effect retrieval.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. An anchoring system comprising:

a housing;

a chamber defined by the housing;

one or more telescopic assemblies disposed in contact with a wall of the housing and operatively responsive to pressure within the chamber for selectively anchoring the housing with respect to a structure; and a piston in operable communication with the chamber and operatively arranged to set the pressure within the chamber.

2. The system as claimed in claim 1 wherein the one or more telescopic assemblies include an anchor extender having a castellation thereon.

3. The system as claimed in claim 1 wherein the piston includes a ratchet profile.

4. The system as claimed in claim 3 wherein the ratchet profile is unidirectional.

5. The system as claimed in claim 3 wherein the ratchet profile is bidirectional.

6. The system as claimed in claim 1 wherein the piston is in operable communication with a remote pressure source.

7. The system as claimed in claim 1 wherein the piston is in operable communication with a lower pressure chamber.

8. The system as claimed in claim 7 wherein the lower pressure chamber is at a pressure lower than hydrostatic pressure at a depth in a wellbore where the system is intended to be deployed.

9. The system as claimed in claim 7 wherein the lower pressure chamber is at atmospheric pressure.

10. The system as claimed in claim 7 wherein the lower pressure chamber is below atmospheric pressure.

11. The system as claimed in claim 1 wherein the one or more telescopic assemblies include an anchor extender having the ability to extend radially of the housing responsive to pressure in the chamber.

12. The system as claimed in claim 11 wherein the anchor extender further includes a concavity therein to core a structure in which the system is set.

13. The system as claimed in claim 11 wherein the one or more telescopic assemblies further include one or more intermediate extenders to increase total radial displacement capability of the one or more telescopic assemblies.

14. The system as claimed in claim 11 wherein the ability to radially extend is radially outwardly.

15. The system as claimed in claim 1 wherein the one or more telescopic assemblies include one or more ratcheting surfaces therein.

16. The system as claimed in claim 1 wherein the system further includes one or more releaseable restraints for selected ones of the one or more telescopic assemblies.

17. The system as claimed in claim 16 wherein the releasable restraint is a shear pin.

18. The system as claimed in claim 16 wherein the one or more releasable restraints have one or more release values.

19. A method for anchoring a tool in a wellbore comprising:

running the system as claimed in claim 1 into the wellbore;

pressuring on the one or more telescopic assemblies by applying pressure against a piston or differentially biasing pressure at the piston for forcing the piston into the chamber;

extending the one or more assemblies radially of the housing; and contacting the one or more assemblies with a structure in which the system is to be set.

20. The method as claimed in claim 19 wherein the extending includes engaging one or more ratcheting surfaces.

21. The method as claimed in claim 19 wherein the contacting includes coring the structure.

22. The method as claimed in claim 19 wherein the method further includes equalizing pressure across the one or more telescopic assemblies to retrieve the system.

23. The method as claimed in claim 19 wherein the method further comprises selectively delaying deployment of one or more of the one or more telescopic assemblies.

* * * * *